US010080407B2

(12) United States Patent
Jackson

(10) Patent No.: US 10,080,407 B2
(45) Date of Patent: Sep. 25, 2018

(54) WRAP WALLET

(71) Applicant: Innodave LLC, Pennington, NJ (US)

(72) Inventor: David Richard Jackson, Pennington, NJ (US)

(73) Assignee: Innodave, LLC, Pennington, NJ (US)

( * ) Notice: Subject to any disclaimer, the term of this patent is extended or adjusted under 35 U.S.C. 154(b) by 349 days.

(21) Appl. No.: 14/530,413

(22) Filed: Oct. 31, 2014

(65) Prior Publication Data

US 2015/0114530 A1 Apr. 30, 2015

Related U.S. Application Data

(60) Provisional application No. 61/897,854, filed on Oct. 31, 2013.

(51) Int. Cl.
*A45C 1/06* (2006.01)

(52) U.S. Cl.
CPC ..... *A45C 1/06* (2013.01); *A45C 2001/065* (2013.01)

(58) Field of Classification Search
CPC ..... A45C 1/06; A45C 2001/065
See application file for complete search history.

(56) References Cited

U.S. PATENT DOCUMENTS 814,205 A * 3/1906 Hawes ..... A45C 1/06 150/143
1,116,660 A * 11/1914 Willis ..... A45C 1/08 150/136
1,305,569 A * 6/1919 Smith ..... A45C 1/06 150/132
1,316,615 A * 9/1919 Hocking ..... A45C 1/06 150/143
1,683,996 A * 9/1928 Snow ..... A45C 11/18 150/147
2,383,108 A * 8/1945 Cibert ..... A45C 1/06 150/132
2,737,991 A * 3/1956 Bass ..... A45C 1/06 150/132
2,746,504 A * 5/1956 Powell ..... A45C 1/06 150/132
3,164,188 A * 1/1965 Cicerello ..... A45C 1/08 150/132
3,299,929 A * 1/1967 Shagin ..... A45C 1/06 150/138

(Continued)

*Primary Examiner* — Tri Mai
(74) *Attorney, Agent, or Firm* — Jeffrey Schox

(57) ABSTRACT

A wrap wallet for carrying a bill of paper currency and a payment card includes a rectangular sheet defining a flap section, a cover section, a back section, a middle tensile section, and an end flap section ordered serially along a length of the rectangular sheet. The flap section cooperates with the cover section to define a card pocket, which retains the standard size card. The card pocket cooperates with the back section to define a bill pocket for retaining a short end of the bill, a longitudinal axis of the bill parallel a long edge of the rectangular sheet. The wrap wallet operates between a wrapped configuration, wherein the middle tensile section and the end flap section can wrap around the card pocket, the bill of paper currency between the middle tensile section and the card pocket, and an open configuration, wherein rectangular sheet defines a substantially planar configuration.

12 Claims, 10 Drawing Sheets

(56) References Cited

U.S. PATENT DOCUMENTS

| | | | | | |
|---|---|---|---|---|---|
| 3,770,034 | A * | 11/1973 | Eastman | A45C 1/06 | 150/146 |
| 4,286,639 | A * | 9/1981 | Murphy | A61F 15/001 | 150/131 |
| 4,671,332 | A * | 6/1987 | McPhee | A45C 1/06 | 150/132 |
| D477,634 | S * | 7/2003 | Malone | D19/26 | |
| 6,886,283 | B2 * | 5/2005 | Arraut | G09F 3/20 | 150/147 |
| 2006/0249234 | A1 * | 11/2006 | Lin | A45C 11/182 | 150/147 |

* cited by examiner

WRAP WALLET

CROSS-REFERENCE TO RELATED APPLICATIONS

This application claims the benefit of U.S. Provisional Application Ser. No. 61/897,854, filed on 31 Oct. 2013, which is incorporated in its entirety by this reference.

TECHNICAL FIELD

This invention relates generally to the field of currency storage and more specifically to a new and useful currency and card storage system in the currency storage field.

DESCRIPTION OF THE EMBODIMENTS

The following description of the embodiments of the invention is not intended to limit the invention to these embodiments, but rather to enable any person skilled in the art to make and use this invention.

A (tri-fold) wrap wallet for carrying a bill of paper currency and a payment card corresponding to an ISO/IEC 7810 ID-1 standard size is described. Some variants of the wrap wallet are shown in FIGS. 1A, 1B, 7A, and 8A-8D. The wrap wallet includes, a rectangular sheet defining a flap section a cover section a back section a middle tensile section and an end flap section ordered serially along a length of the rectangular sheet The flap section can cooperate with the cover section to define a card pocket which can retain one or more standard size cards. The card pocket can cooperate with the back section define a bill pocket for retaining a short end of the bill, a longitudinal axis of the bill parallel a long edge of the rectangular sheet. The wrap wallet can operate between a wrapped configuration (shown in FIG. 7B and 8C) and an open configuration (shown in FIG. 8A). In the wrapped configuration, the middle tensile section and the end flap section can wrap around the card pocket the bill of paper currency between the middle tensile section and the end flap section the middle tensile section and the end flap section substantially enveloping the card pocket and the bill. In the open configuration, the card pocket the middle tensile section and the end flap section define a substantially planar configuration, the bill of paper currency and standard size cards accessible to a user external the wrap wallet.

Figure 12A:
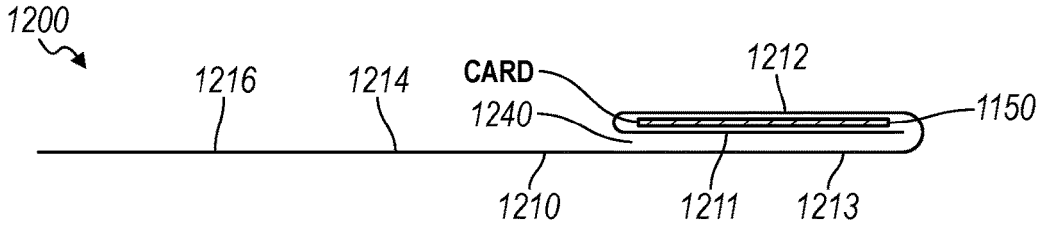
FIGS. 12A-12D are schematic representations of variations of the wrap wallet.

In the particular embodiment shown in FIG. 12A, the wrap wallet 1200 for carrying a bill of paper currency and a payment or identification card corresponding to an ISO/IEC 7810 ID-1 standard size (or a standard size Passport, business card, etc.) includes a rectangular sheet 1210 defining an inner surface and an outer surface, the inner surface defining a coefficient of friction greater than or equal to a coefficient of friction defined by the outer surface. The rectangular sheet 1210 can define a width dimension corresponding to at least a card width of the payment card and a length dimension corresponding to greater than five multiples of a card length of the payment card, the card width greater than the card length. The rectangular sheet 1210 defines five sections ordered serially across the rectangular sheet 1210 from a first short edge of the rectangular sheet 1210 to an opposing short edge of the rectangular sheet 1210 opposite the first short edge, the five sections including a flap section 1211, a cover section 1212, a back section 1213, a tensile middle section 1214, and an end flap section 1216 arranged in order, the flap section 1211 adjacent a short edge of the rectangular sheet 1210. The wrap wallet further includes a card pocket defined by the flap section folded over the cover section, the inner surface of the flap section adjacent the inner surface of the cover section, a linear slot cut through the cover section for inserting a portion of the payment card between the inner surface of the cover section and the inner section of the flap section. The linear slot can be defined at an acute angle relative a long edge of the rectangular sheet, can be parallel the long edge of the rectangular sheet, or can be parallel the short edge of the rectangular sheet. The card pocket is configured to receive a portion of the payment card between the cover section and the flap section and a portion of the payment card arranged over the cover section, the payment card providing a substantially rigid structure to the card pocket. The wallet further includes a bill pocket for retaining a short end of the bill of paper currency, the bill pocket defined by the card pocket folded over the back section, the card pocket retained over the back section with a pair of fasteners penetrating and coupling the back section, the flap section, and the cover section. A first fastener in the pair of fasteners is proximal the long edge of the rectangular sheet, a second fastener in the pair of fasteners is proximal a second long edge of the rectangular sheet opposite the long edge. The bill pocket is configured to receive and retain the short end of the bill, the short end corresponding to at least one-third of a length of the bill, the bill oriented parallel the long edge of the rectangular sheet. The bill pocket is configured to fold over the tensile middle section retaining the bill between the cover section and the middle tensile section, the outer surface of the cover section adjacent the inner surface of the tensile middle section. The end flap section is configured to fold over the back section, the outer surface of the back section adjacent the inner surface of the end flap section, the end flap section substantially aligned with the bill pocket, the end flap section configured to substantially enclose and retain the bill and the payment card within the width dimension of the rectangular sheet. Variants of the wrap wallet are shown in the wrap wallet 800 of FIGS. 8A-8D and the wrap wallet 900 of FIG. 9F (card pocket 850, 950, flap section 811, 911, cover section 812, 912, linear slot 880, 980, rectangular sheet 810, 910, bill pocket 840, back section 813, fastener 870, middle tensile section 814, end flap section 816).

Figure 1A:
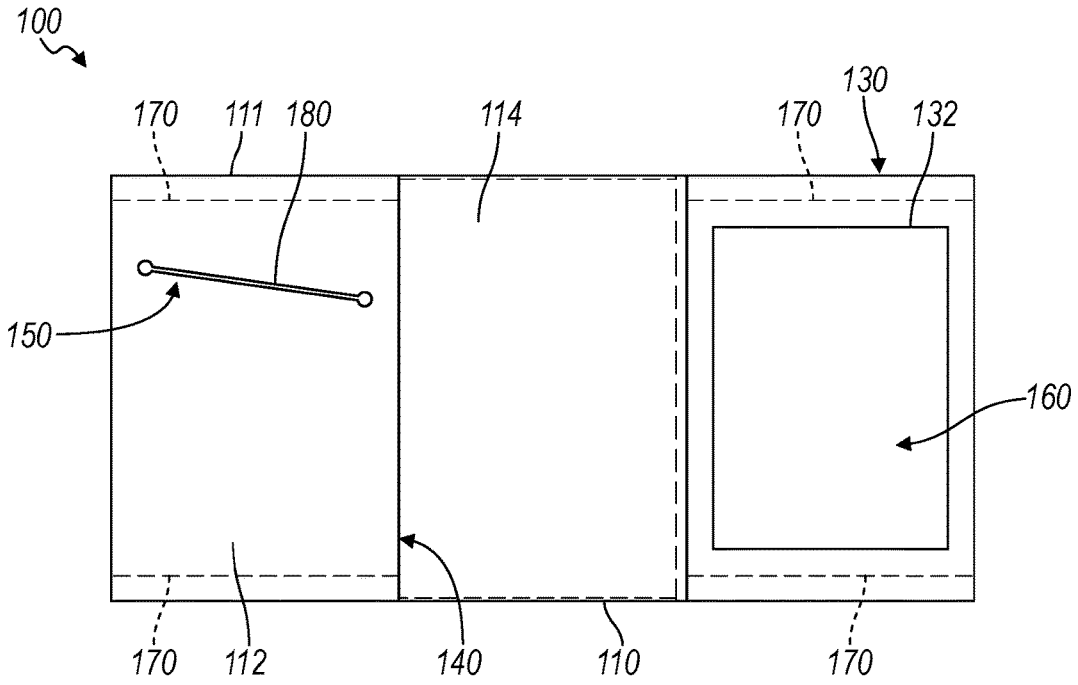
FIGS. 1A and 1B are schematic representations of a variation of the wrap wallet.
Figure 1B:
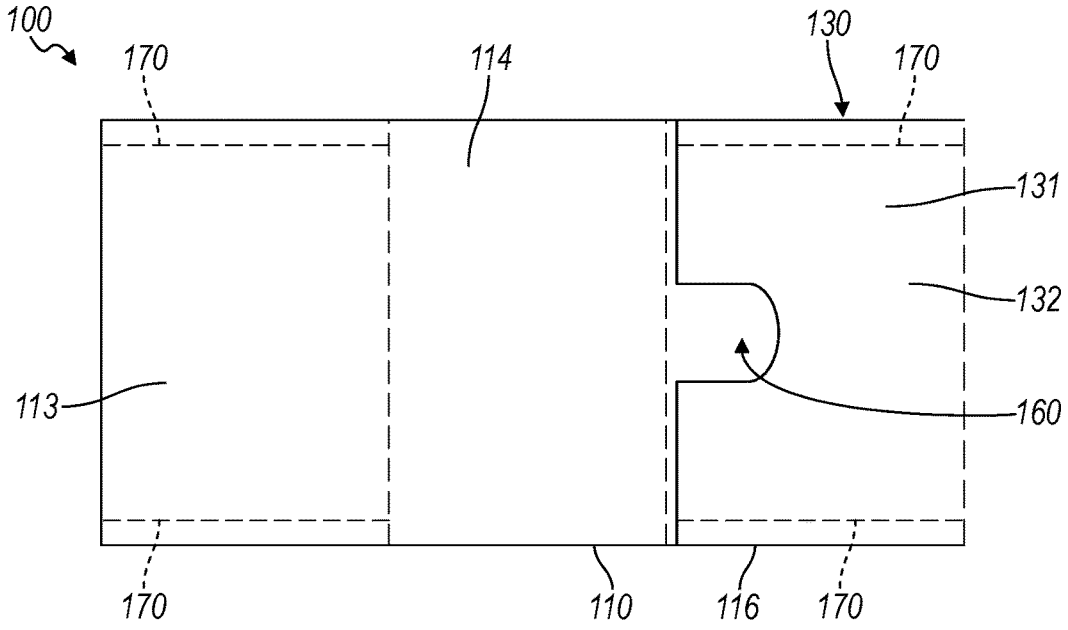

A variation of the wrap wallet, shown in FIGS. 1A and 1B, includes a second rectangular sheet 130 defining an interior surface and an exterior surface, the interior surface defining a coefficient of friction greater than or equal to the coefficient of friction of the exterior surface, the second rectangular sheet 130 defining two serial sections, each section measuring at least the card length and the card width, the interior surface of a first serial section of the second rectangular sheet 130 coupled to the outer surface of the end flap defining an external card pocket, the interior surface of a second serial section of the second rectangular sheet 130 coupled to the inner surface of the end flap defining an internal card pocket a pair of fasteners 170 coupling the first serial section, the end flap, and the second serial section, a first fastener 170 of the pair of fasteners 170 proximal the long edge of the rectangular sheet no, a second fastener 170 of the pair of fasteners 170 proximal the second long edge. The internal card pocket 150 is configured to receive and retain a second payment card between the end flap section 111 and the second serial section of the second rectangular sheet 130, the second payment card providing structure to the internal card pocket 150. The external pocket is configured to receive and retain a third payment card between the end flap section and the second serial section of the second rectangular sheet, the third payment card providing structure to the external card pocket. The end flap section is configured to fold over the back section, the outer surface of the back section adjacent the internal card pocket, the internal card pocket and external card pocket substantially aligned with the bill pocket, the end flap section, the internal pocket, and the external pocket configured to substantially enclose and retain the bill and the payment card within the width dimension of the rectangular sheet and retain the internal pocket adjacent the back section. A variant of the wrap wallet having an external pocket is shown in FIGS. 8A-8D (end flap section 811, second rectangular sheet 830, back section 813, bill pocket 840, end flap section 816, rectangular sheet 810, back section 813).

Another variation of the wrap wallet shown in FIGS. 7A, 7B, and 8A-8D includes a second card pocket 760, 860 defined by the end flap folded over the inner flap, a pair of fasteners 770, 870 coupling the inner flap section 815 and the end flap section 716, 816, a first fastener 770, 870 of the pair of fasteners 770, 870 proximal the long edge of the rectangular sheet 710, 810, a second fastener 770, 870 of the pair of fasteners 770, 870 proximal the second long edge. The second card pocket 760, 860 is configured to receive and retain a payment card between the end flap section 716, 816 and the inner flap section 815, the card providing structure to the second card pocket 760, 860. The second card pocket 760, 860 is configured to fold over the back section 713, 813, the outer surface of the back section 713, 813 adjacent the second card pocket 760, 860, the second card pocket 760, 860 substantially aligned with the bill pocket 740, 840 and configured to substantially enclose and retain the bill and the payment card within the width dimension of the rectangular sheet 710, 810 and retain second card pocket 760, 860 adjacent the back section 713, 813.

Figure 11A:
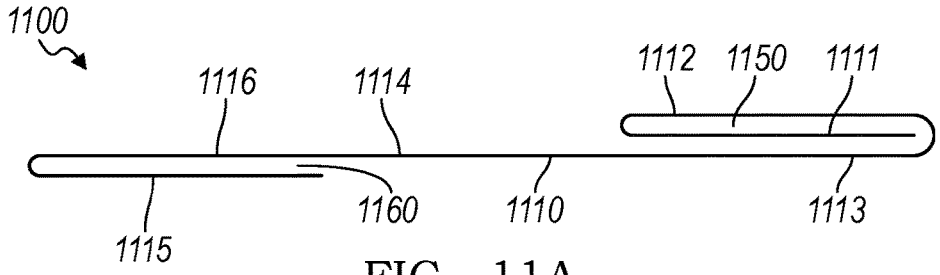
FIGS. 11A-11D are schematic representations of variations of the wrap wallet.
Figure 11B:
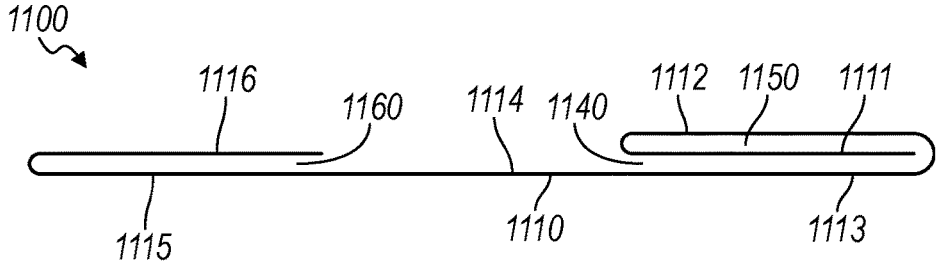

As shown in FIG. 11B, another variation of the wrap wallet 1100 includes a second card pocket 1160 defined by the end flap folded over the inner flap, a pair of fasteners coupling the inner flap section 1115 and the end flap section 1116, the inner surface of the inner flap section 1115 adjacent the inner surface of the end flap section 1116, a first fastener of the pair of fasteners proximal the long edge of the rectangular sheet 1110, a second fastener of the pair of fasteners proximal the second long edge. The second card pocket 1160 is configured to receive and retain a payment card between the end flap section 1116 and the inner flap section 1115, the card providing structure to the second card pocket 1160. The second card pocket 1160 is configured to fold over the back section 1113, the outer surface of the back section 1113 adjacent the outer surface of the end flap section 1116 corresponding to the second card pocket 1160, the second card pocket 1160 substantially aligned with the bill pocket 1140 and configured to substantially enclose and retain the bill and the payment card within the width dimension of the rectangular sheet 1110 and retain the outer surface of the end flap section 1116 adjacent the back surface.

1. Applications

Figure 8A:
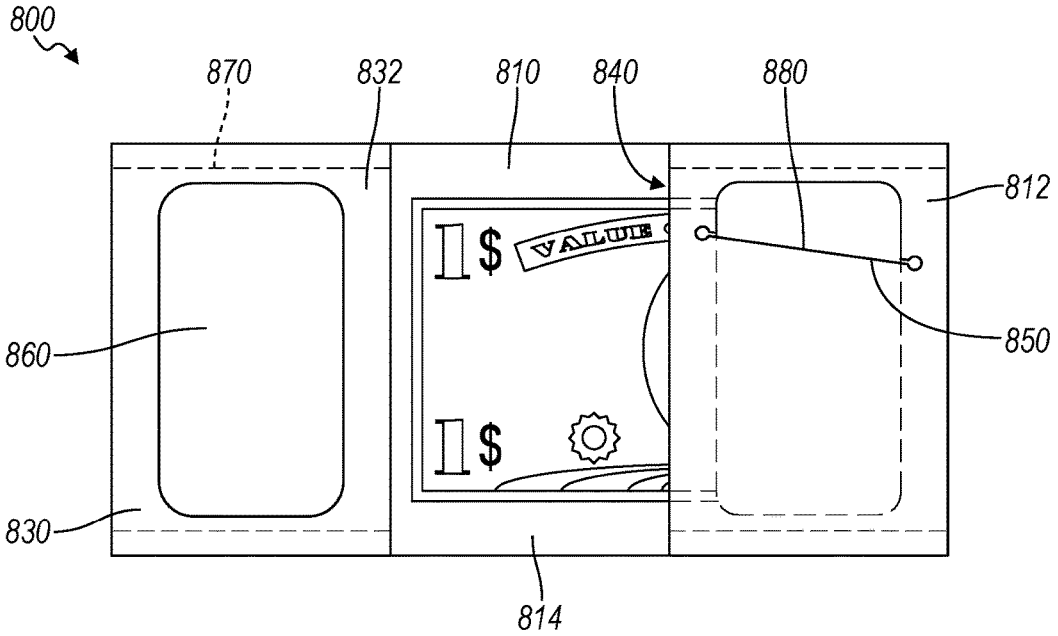
FIGS. 8A-8D are schematic representations of a variation of the wrap wallet.
Figure 8B:
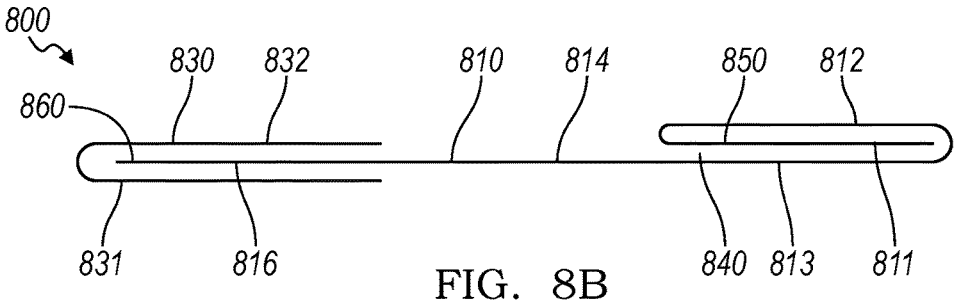
Figure 8C:
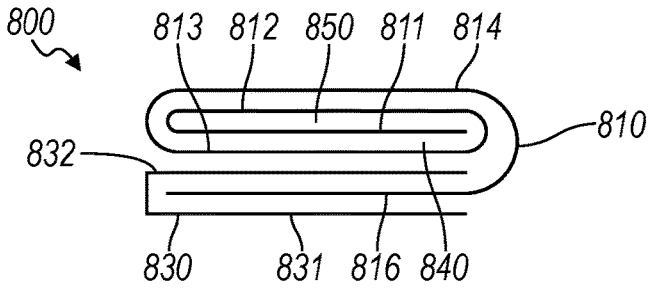

Generally, the wrap wallet functions to retain one or more bills of paper currency (e.g., U.S. Dollars, Euros, Japanese Yen, etc.) in the bill pocket, which can engage and substantially enclose a small portion of the bill (i.e., the short end), one or more payment cards of ISO/IEC 7810 ID-1 standard size (e.g., credit cards, Government Identification cards, etc.), a passport, and/or a business card in the card pocket, the payment card providing structure to the card pocket and cooperating with the bill pocket to retain the bill(s) of paper currency within the bill pocket. The wrap wallet can define and operate between two configurations: an open configuration and a wrapped configuration. In the open configuration, the wrap wallet can lie substantially planar such that cards retained within the card pocket and/or bills retained within the bill pocket can be accessed and removed from the wrap wallet for use (e.g., for payment). In the closed configuration, the wrap wallet envelops cards retained within the card pocket and bills retained by the bill pocket by wrapping a portion of the rectangular sheet around the card pocket (i.e., the middle tensile section and the end flap section), enclosing a portion of the bill(s) between the card pocket and the rectangular sheet. The bill pocket retains a portion of the bill(s), thereby constraining a length of the bill(s) (i.e., longitudinal axis) parallel the long edge of the rectangular sheet. By wrapping the rectangular sheet around the card pocket, the rectangular sheet functions to constrain the bill(s) longitudinally (i.e., parallel the long edge of the rectangular sheet). Furthermore, by wrapping around the card pocket, the rectangular sheet prevents latitudinal motion of cards out of the card pocket, thereby limiting risk of losing a card from the card pocket. The wrap wallet can also include a second card pocket, retaining one or more cards. As the wrap wallet can be defined by a single sheet of material, in the wrapped configuration, the wrap wallet can define a narrow thickness or profile, such that the wrap wallet can, for example, fit within a pant pocket and define a small and low-profile bulge within a rear (or front) pant pocket. Furthermore, the wrap wallet can be slightly larger than an ISO/IEC 7810 ID-1 standard size card. Thus, in the wrapped configuration, the wrap wallet can be approximately the size of a deck of cards. In the wrapped configuration, the wrap wallet can include seven stacked layers of material (i.e., the flap section, the cover section, the back section, the middle tensile section, the end flap section, the first half of the second rectangular sheet, and the second half of the second rectangular sheet) excluding cards and bills retained within the wrapped wallet. In a typical tri-fold wallet, which retains a bill with a pocket that supports an entire length of the bill, in a tri-fold configuration, the typical tri-fold wallet requires at least six stacked layers of material excluding layers to define pockets to retain cards. Additional layers added to the typical tri-fold wallet add to thickness and profile of the wallet in the wrapped configuration. The wrap wallet functions to minimize the profile and thickness of the wrap wallet in the wrap configuration by supporting a portion of a bill of paper currency instead of the entirety of the length of the bill (i.e., a longitudinal pocket). A variant of the wrap wallet in the closed configuration is shown in FIG. 8C (card pocket 850, bill pocket 840, rectangular sheet 810, middle tensile section 814, end flap section 816, rectangular sheet 810). A variant of the wrap wallet with a second card pocket is shown in FIG. 8A (second card pocket 860).

Figure 7A:
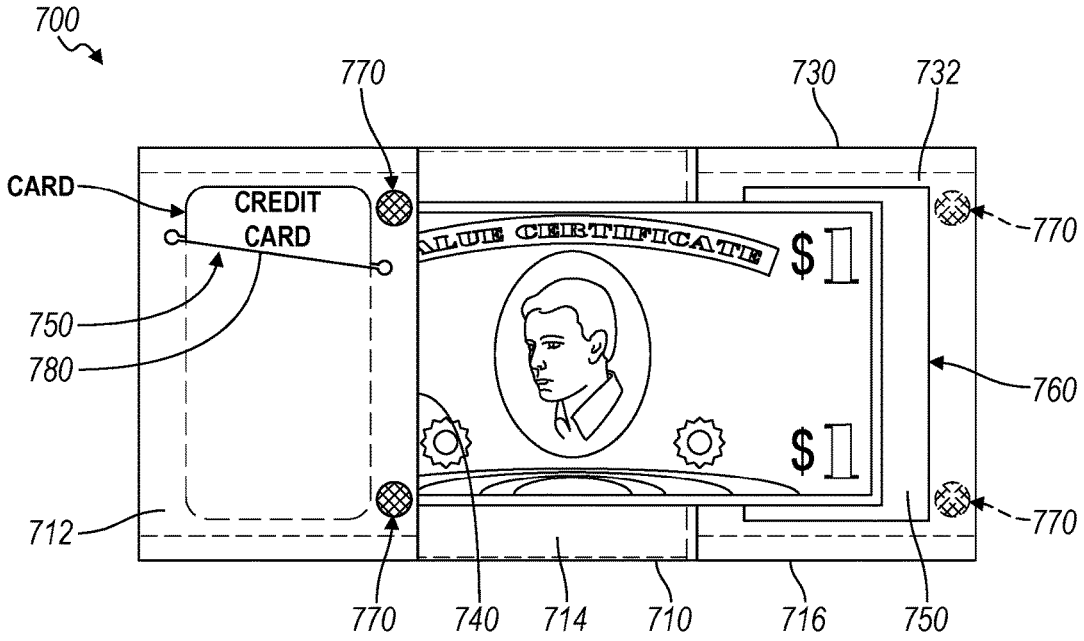
FIGS. 7A and 7B are schematic representations of a variation of the wrap wallet.
Figure 7B:
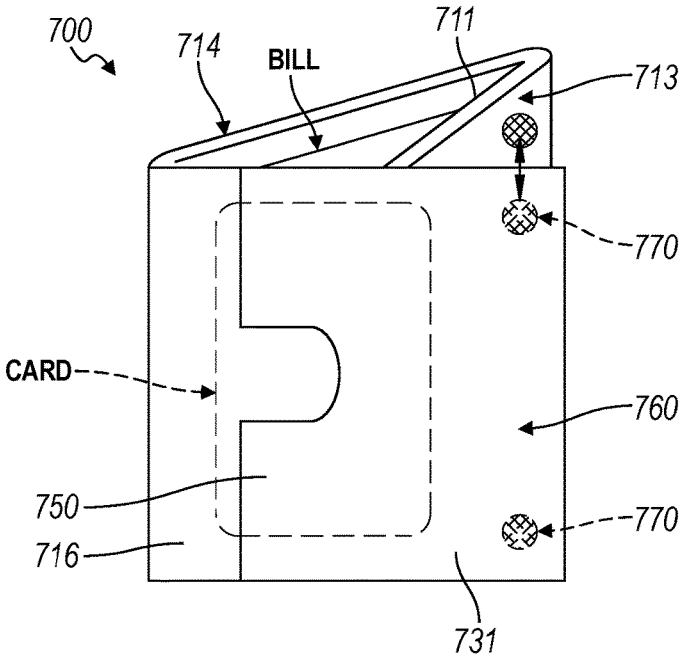

In one example application, the wrap wallet can be formed from a single sheet of material (e.g., leather), thereby defining a narrow thickness (i.e., profile) in a wrapped configuration. When a user may place the wrap wallet in a pocket (e.g., a pant pocket), the wrap wallet generates a minimal profile within the pocket. In the wrapped configuration, the wrap wallet can be roll-folded about the card pocket.The card pocket, which can be defined by folding the flap section over the cover section, the inner surface of the flap section adjacent the inner surface of the cover section, can retain one or more credit cards of ISO/IEC 7810 ID-1 standard size. The card pocket can define a diagonal slot relative a long edge in the cover section through which credit cards (or other standard sized cards) can be removably inserted by a user, a long axis of each card parallel a short edge of the rectangular sheet. A portion of each card can be retained over the cover section and a second portion of each card, inserted through the diagonal slot, can be retained within the card pocket. The card pocket can cooperate with the back section of the rectangular sheet to form a bill pocket by folding the card pocket over the back section, the outer surface of the cover section adjacent the inner surface of the back section. The bill pocket can retain one or more bills of paper currency (e.g., a one U.S. dollar bill) between the card pocket and the back section, such that a long axis of each bill is parallel the long edge of the rectangular sheet, the bill pocket retaining an end of each bill (e.g., less than one-third of the length of each bill) between the inner surface of the back section and the outer surface of the cover section. A variant of the wrap wallet in the wrapped configuration is shown in FIG. 8C (card pocket 850, flap section 811, cover section 812). A variant of the wrap wallet with a card pocket is shown in FIGS. 7A and 7B (rectangular sheet 710, cover section 712, back section 713, bill pocket 740 card pocket 750, diagonal slot 780).

In one application, the wrap wallet can include a rectangular sheet of leather with a grain side and a flesh side, the flesh side defining a higher coefficient of friction than the grain side. The rectangular sheet can have substantially sharp, ninety-degree corners. The rectangular sheet of leather can be subdivided into six sections serially along the length of the rectangular sheet, each section of a width (i.e., along an axis parallel the short edge of the rectangular sheet) of at least the card width of the ISO/IEC 7810 ID-1 standard size (e.g., 85.60 millimeters) and each section of a length (i.e., along an axis parallel the long edge of the rectangular sheet) of at least the card length of the ISO/IEC 7810 ID-1 standard size (e.g., 53.98 millimeters). A first flap section adjacent the short edge of the rectangular sheet can be folded over an adjacent cover section of the rectangular sheet, thereby forming a card pocket.

The wrap wallet minimizes the wrap wallet footprint (i.e., width and length) when in the wrapped configuration to dimensions that are slightly larger than the dimensions of a credit card (e.g., slightly larger than 85.60 mm×53.98 mm). Furthermore, the wrap wallet minimizes the wrap wallet thickness in the wrapped configuration by retaining the bill of paper currency along a short edge (e.g., width) instead of along the entirety of the bill of paper currency length, thereby limiting material and thickness that supports the entirety of the length of the paper bill of paper currency. In one variation, the bill pocket of the wrap wallet retains an end of the bill of paper currency (e.g., a first section of the bill of paper currency length, along the bill of paper currency width). A second section of the bill of paper currency is retained by folding the first wallet section over the short end of the bill, thereby retaining the bill of paper currency between the short end of the bill and the first wallet section. A third section of the bill of paper currency length can additionally be retained by folding the second wallet section over the short end of the bill, such that the third bill of paper currency section is encapsulated between the short end of the bill and the second wallet section. A variant of the wrap wallet with a bill pocket is shown in FIG. 1A (bill pocket 140).

2. Rectangular Sheet

The rectangular sheet can define an inner surface and an outer surface, the rectangular sheet of a width dimension corresponding to at least a card width of the payment card and a length dimension corresponding to greater than five multiples of a card length of the payment card, the card width greater than the card length, the rectangular sheet defining five sections of the rectangular sheet ordered serially across the rectangular sheet from a first short edge of the rectangular sheet to an opposing short edge of the rectangular sheet opposite the first short edge, the five sections comprising a flap section, a cover section, a back section, a tensile middle section, and an end flap section arranged in order, the flap section adjacent a short edge of the rectangular sheet. Generally, the rectangular sheet functions to substantially envelop and retain paper currency and payment card(s).

The rectangular sheet can be of a substantially rectangular shape with the width dimension corresponding to at least a card width of an ISO/IEC 7810 ID-1 standard size payment card (i.e., 85.60 millimeters) or larger. The length dimension of the rectangular sheet can correspond to at least five multiples of a card length of the ISO/IEC 7810 ID-1 standard size payment card (i.e., five multiples of 53.98 millimeters) or larger. For example, the width dimension can be ninety-five millimeters and the length dimension can be 275 millimeters. However, the rectangular sheet can be of any other size suitable to accommodate paper currency and/or a payment card, Government identification card, gift card, etc. The rectangular sheet can define sharp right-angled corners, chamfered corners, rounded corners, etc. The rectangular sheet can be substantially planar, such that the inner surface and the outer surface of the rectangular sheet can be substantially parallel and planar. Alternatively, inner surface and/or the outer surface can include a bezel, extruded ridges, a geometric pattern of shapes offset from the inner surface and/or outer surface, or any other feature forming a substantially three-dimensional or non-planar rectangular sheet. Likewise, the inner and/or outer surface of the rectangular sheet can be textured, such as with raised polka dots, ridges, checkers, etc. The rectangular sheet can be cut to size and shape by any cutting means, such as with a blade (e.g., a knife), scissors, a cutout, a leather skiver, a leather splitter, a punch, or with a laser cutter. For example, a laser cutter can be programmed to cut a strip of leather into a substantially rectangular shape with rounded corners of a particular curvature. The laser cutter can also cut a window (i.e., a hole) in the cover section, for example, to aid removal of a card from the card pocket or to make a face of a card (e.g., a face of a Government Identification card) visible to an external to the card pocket. However, the rectangular sheet can be of any other suitable shape, size, and cut to shape and size in any other way.

The rectangular sheet can be of any material, such as leather, duct tape, linen, silk, denim, velvet, metal, plastic, etc. Alternatively, the rectangular sheet can be defined by any other polymeric material and include one or more layers. Additionally, the rectangular sheet can define the inner surface, such that the inner surface defines a coefficient of friction equal to or greater than the coefficient of friction defined by the outer surface. For example, leather includes a grain side (i.e., outside of the animal hide) and a flesh side (i.e., the inside of the animal hide), the flesh side of a greater coefficient of friction than a coefficient of friction of the grain side. In this example, the flesh side is more coarse and less smooth to the touch than the grain side. An object (e.g., a credit card or a bill of paper currency) can slide along (i.e., contact) the grain side smoothly and with less frictional resistance than when the object slides along the flesh side. Thus, the inner surface can function to retain a card, a bill, etc. within the card pocket or the bill pocket through frictional resistance and the outer surface can aid removal of the card, the bill, etc. from the card pocket or the bill pocket due to lower frictional resistance of the outer surface than frictional resistance of the inner surface. In another example, when short ends of a stack of bills of paper currency may be inserted in the bill pocket, a user may retrieve a bill on the top of the stack of bills from the bill pocket without removing other bills in the stack from the bill pocket because the higher coefficient of friction of the inner surface retains the remaining bills in the stack and the lower coefficient of friction of the outer surface of the flap section allows the top bill to slide out from inside the bill pocket.

The rectangular sheet can define five (or more) sections serially ordered along the length of the rectangular sheet. Each section can be of a section length corresponding to at least the card length (i.e., 53.98 millimeters) or larger. The flap section can be defined adjacent a first short edge of the rectangular sheet. The cover section can be defined adjacent the flap section and can be of a section length equal to or larger than the section length of the flap section. The back section can be defined adjacent the cover section, such that the cover section is situated between the flap section and the back section. The back section can be of a section length equal to or longer than the section length of the cover section. The middle tensile section can be defined adjacent the back section. The middle tensile section can be of a section length equal to or longer than the back section, such that the middle tensile section can wrap around the card pocket and bill pocket and accommodate thickness added by cards and/or bills of paper currency. The back section can be defined between the middle tensile section and the cover section. The end flap section can be defined adjacent the middle tensile section. The end flap section can be of a section length equal to or longer than the cover flap section. The end flap section can be adjacent (and coincident) a second short edge of the rectangular sheet opposite the first short edge. A variant of the wrap wallet is shown in FIG. 8B (flap section 811, rectangular sheet 810, cover section 812, flap section 811, back section 813, middle tensile section 814, card pocket 850, bill pocket 840, end flap section 816).

Figure 10A:
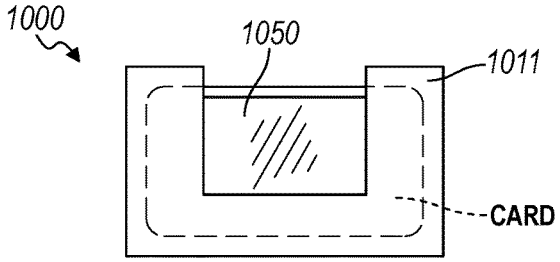
FIGS. 10A-10G are schematic representations of variations of the wrap wallet.
Figure 10B:
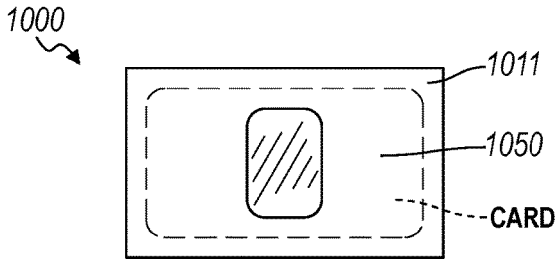
Figure 10C:
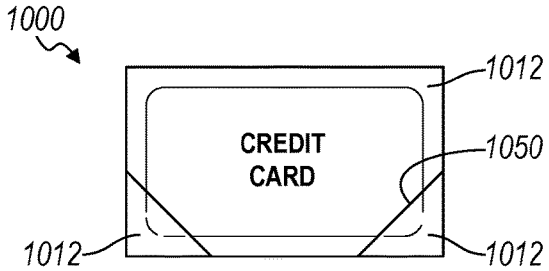
Figure 10D:
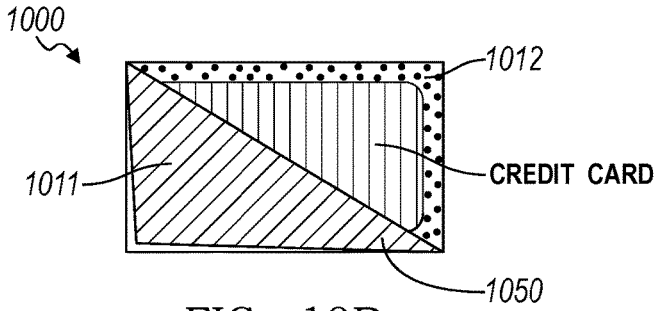
Figure 10E:
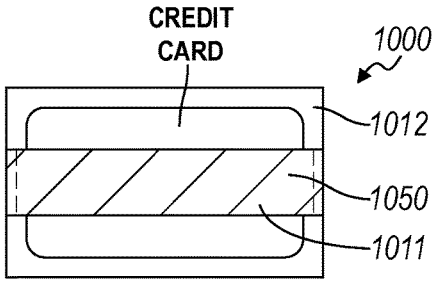
Figure 10F:
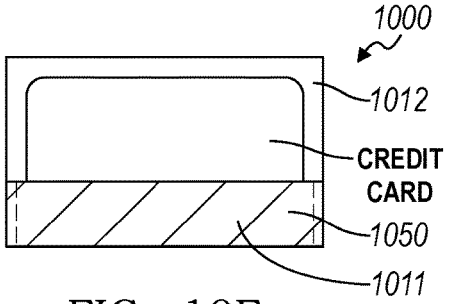
Figure 10G:
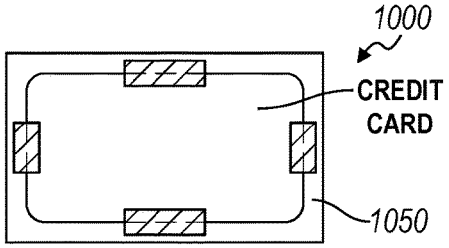

In one implementation of the wrap wallet 1000, the rectangular sheet 1010 can define a substantially triangular flap section 1011 as shown in FIGS. 10C and 10D. Thus, when the flap section 1011, for example, folds over the cover section 1012, the flap section 1011 forms a triangular flap arranged over the (substantially rectangular) cover section 1012.

A variation of the rectangular sheet can be of a substantially rectangular shape with the width dimension corresponding to at least a card width of an ISO/IEC 7810 ID-1 standard size payment card (i.e., 85.60 millimeters) or larger and the length dimension of the rectangular sheet can correspond to at least six multiples of a card length of the ISO/IEC 7810 ID-1 standard size payment card (i.e., six multiples of 53.98 millimeters) or larger. In this variation, the rectangular sheet can define six (or more) sections serially ordered along the length of the rectangular sheet from a first short edge of the rectangular sheet to a second short edge of the rectangular sheet opposite the first short edge in substantially the following order: flap section, cover section, back section, middle tensile section, inner flap section, and end flap section. Each section can be of a section length corresponding to at least the card length (i.e., 53.98 millimeters) or larger. The cover section can be of a section length equal to or larger than a section length of the flap section. The back section can be of a section length equal to or longer than the section length of the cover section. The middle tensile section can be of a section length equal to or longer than the back section, such that the middle tensile section can wrap around the card pocket and bill pocket and accommodate thickness added by cards and/or bills of paper currency. The inner flap section can be defined between the middle tensile section and the end flap section. The inner flap section can be of a section length equal to or longer than a section length of the end flap section. The end flap section can be of a section length equal to or longer than the cover flap section. The end flap section can be adjacent (and coincident) a second short edge of the rectangular sheet opposite the first short edge. A variant of the wrap wallet is shown in FIGS. 11A and 11B (rectangular sheet 1110, flap section 1111, cover section 1112, back section 1113, middle tensile section 1114, inner flap section 1115, and end flap section 1116, card pocket 1150, bill pocket 1140).

In one variation of the wrap wallet, the rectangular sheet can be defined by two or more layers of material, each layer of material coupled to each adjacent layer of material. The layers can be coupled together such as with an adhesive (e.g., epoxy), sewn together, or otherwise bonded together (e.g., with rivets, staples, nails). For example, a first layer of denim fabric can be stapled to a second layer of velvet, the denim layer defining the inner surface of the rectangular sheet, the velvet layer defining the outer surface of the rectangular sheet.

3. Card Pocket

As shown in FIGS. 1A, 1B, and 10A-10G, the card pocket 150, 1050 can be defined by the flap section 111, 1011 folded over the cover section 112, 1012, the inner surface of the flap section 111, 1011 adjacent the inner surface of the cover section 112, 1012, a linear slot 180 cut through the cover section 112, 1012 for inserting a portion of the payment card between the inner surface of the cover section 112, 1012 and the inner section of the flap section 111, 1011, the linear slot 180 defining an acute angle relative a long edge of the rectangular sheet 110, 1010, wherein the card pocket 150, 1050 is configured to receive a portion of the payment card between the cover section 112, 1012 and the flap section 111, 1011 and a portion of the payment card arranged over the cover section 112, 1012, the payment card providing a substantially rigid structure to the card pocket 150, 1050. Generally, the card pocket 150, 1050 functions to support and retain one or more cards, the cards providing structure to the card pocket 150, 1050 such that the card pocket 150, 1050 can define a structural core about which a remaining portion of the rectangular sheet 110, 1010 can wrap around. The card pocket 150, 1050 can also cooperate with the back section 113, 1013 to define the bill pocket 140, 1040, cards retained with the card pocket 150, 1050 providing structure to retain a bill of paper currency between the back section 113, 1013 and the card pocket 150, 1050. As the flap section in 1011 and the cover section 112, 1012 can each be of a size substantially corresponding to the ISO/IEC 7810 ID-1 standard size card, the card pocket 150, 1050, thus, can be of dimensions substantially corresponding to the ISO/IEC 7810 ID-1 standard size card.

Figure 2:
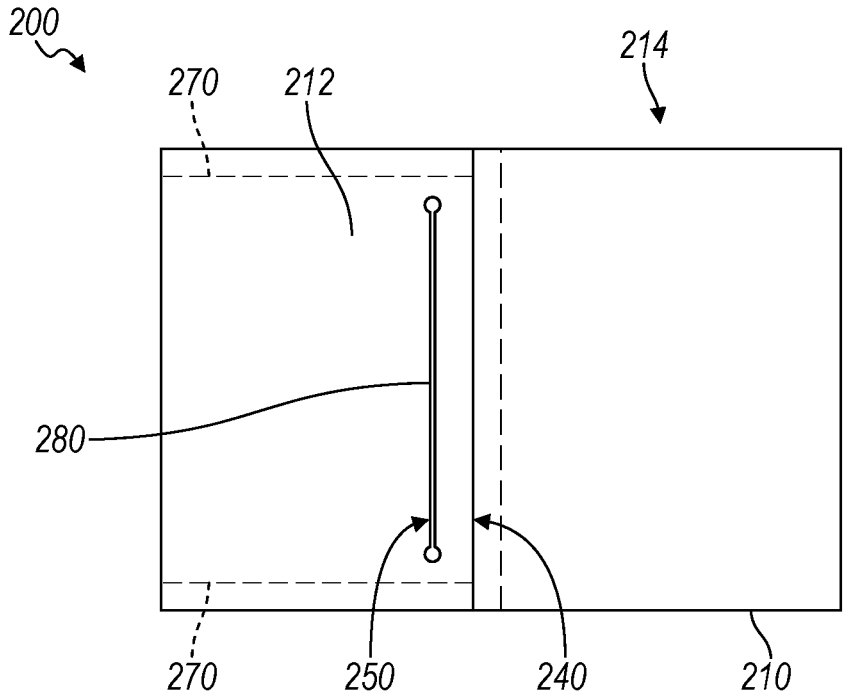
FIG. 2 is a schematic representation of a variation of the wrap wallet.
Figure 3:
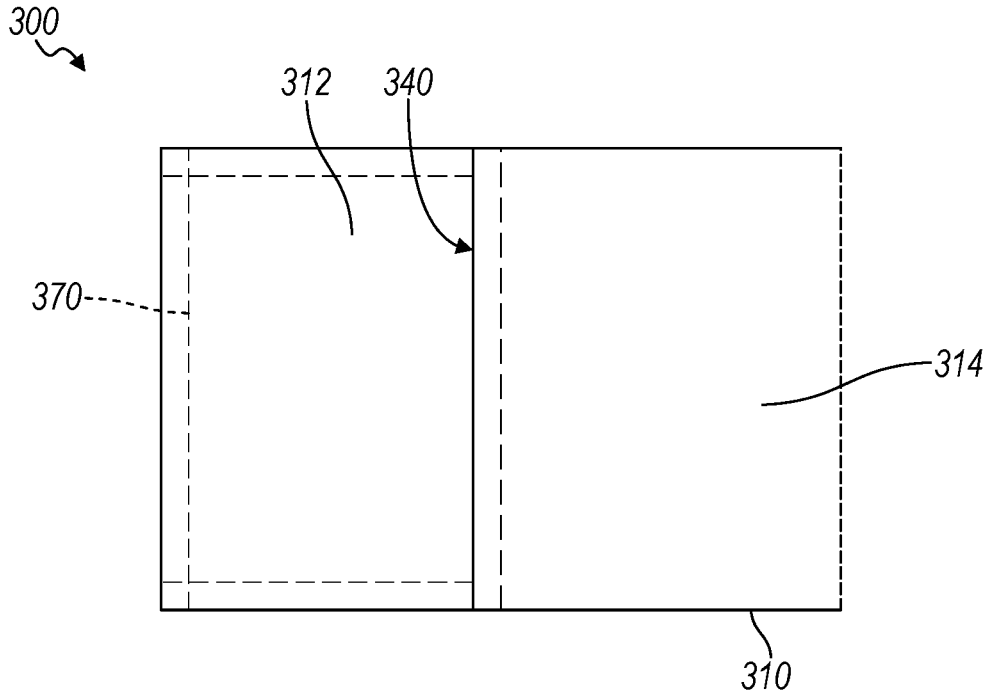
FIG. 3 is a schematic representation of a variation of the wrap wallet.
Figure 4:
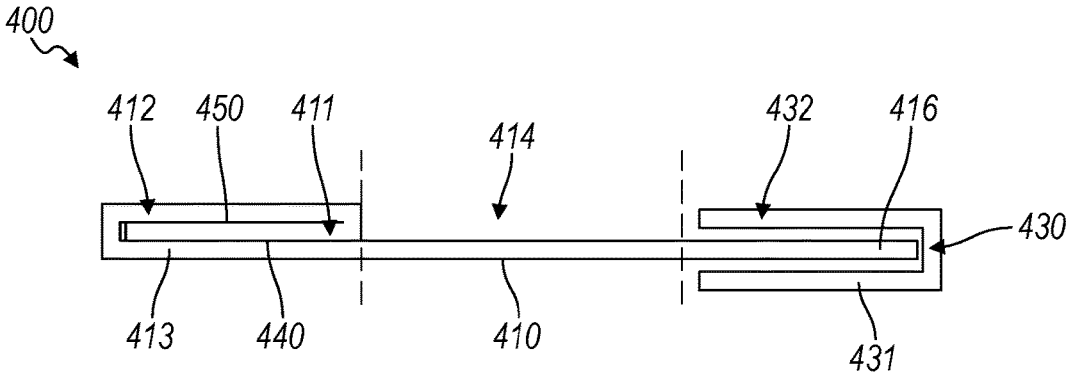
FIG. 4 is a schematic representation of a variation of the wrap wallet.

As seen in the variations shown in FIGS. 2, 3, and 4, the card pocket 250, 450 of the wrap wallet 200, 300, 400 can be defined by folding the flap section 411 over the cover section 212, 312, 412 along an intersection between the flap section 411 and the cover section 212, 312, 412, the flap section 411 lying substantially parallel to a plane of the cover section 212, 312, 412 thereby defining the card pocket 250, 450 between the flap section 411 and the cover section 212, 312, 412. In the implementation shown in FIGS. 12A and 12C, the card pocket 1250 can be defined by folding the flap section 1211 such that the inner surface of the flap section 1211 lies adjacent the inner surface of the cover section 1212. The card pocket 1250 can retain one or more ISO/IEC 7810 ID-1 standard size cards between the inner surface of the flap section 1211 and the inner surface of the cover section 1212. The flap section 1211 can be retained over the cover section 1212 by a fastener (e.g., rivets, nails staples, stitches, etc.), adhesive, or any other bonding means along a periphery of the flap section 1211 and the cover section 1212, such that an edge of the flap section 1211 can be coupled to an edge of the cover section 1212. For example, a layer of fabric glue can be distributed in a substantially linear path proximal and parallel a first edge of the inner surface of the flap section 1211, the first edge parallel the long edge of the rectangular sheet 1210. In this example, the layer of fabric glue can also be distributed in a substantially linear path proximal and parallel a second edge of the inner surface of the flap section 1211, the second edge opposite the first edge and parallel the long edge of the rectangular sheet 1210. The short edge of the rectangular sheet 1210 corresponding to the flap section 1211 can also couple to the cover section 1212 parallel the short edge of the rectangular sheet 1210, the flap section 1211 and the cover section 1212 thereby cooperating to completely enclose the card pocket 1250. The card pocket 1250 can be reinforced, such as with a metal (e.g., nitinol), or plastic member, such that the card pocket 1250 is substantially rigid. The reinforcement material can be coupled and/or embedded within the rectangular sheet 1210.

As shown in FIG. 1A, the card pocket 150 of the wrap wallet can include a slot 180 cut through and substantially across the length of the cover section 112 substantially proximal an edge of the cover section 112 parallel the long edge of the rectangular sheet 110. Alternatively, the slot 180 can cut across the cover section 112 coincident a center of the cover section 112. The slot 180 can be substantially linear or nonlinear. For example, the slot 180 can define a zig-zag profile or serpentine cut. Furthermore, the slot 180 can be oriented at an acute angle relative the long edge of the rectangular sheet 110. The slot 180 can further define a relief hole coincident an end of the slot 180, such that the relief hole prevents propagation of the slot 180 beyond the relief hole and limits stresses concentrated at the end of the slot 180 due to sharp (and/or abrupt) conclusion of the slot 180. A variant of the wrap wallet 200 with a card pocket is also shown in FIG. 2 (card pocket 250, slot 280, cover section 212, rectangular sheet 210).

Figure 9A:
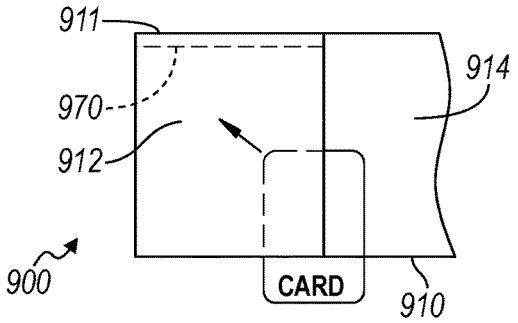
FIGS. 9A-9G are flowchart representations of variations of the wrap wallet.
Figure 9E:
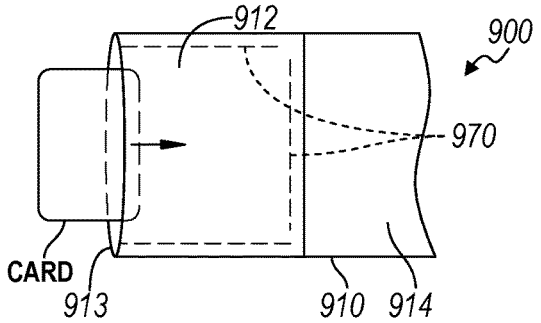
Figure 9B:
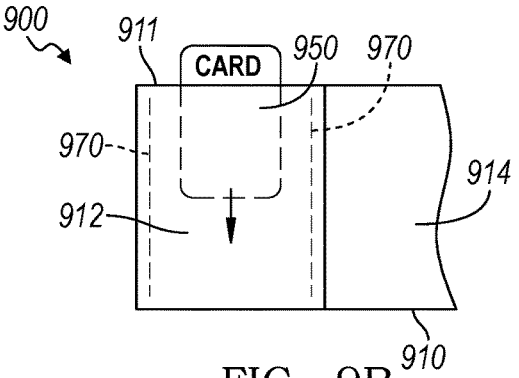
Figure 9F:
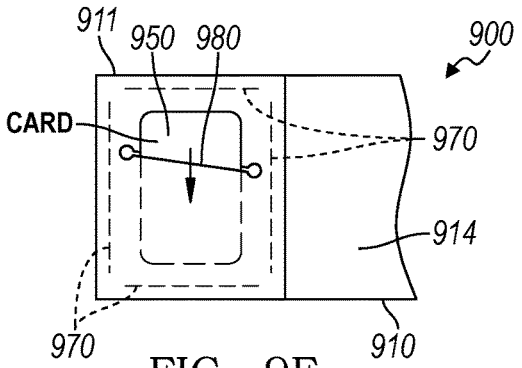
Figure 9C:
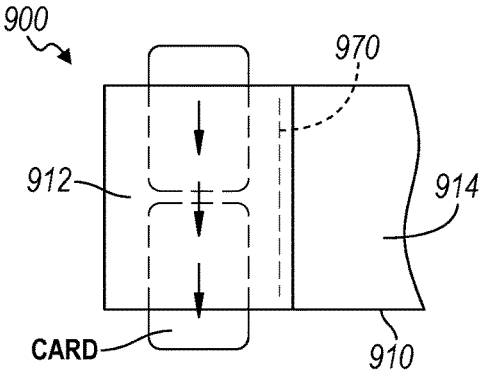
Figure 9G:
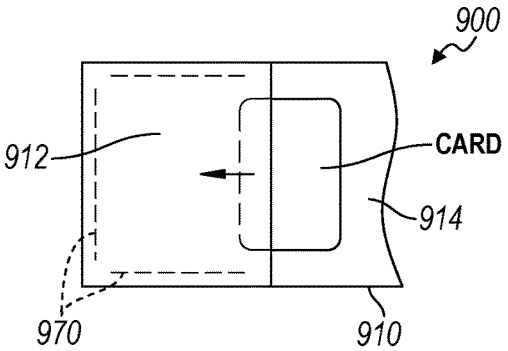
Figure 9D:
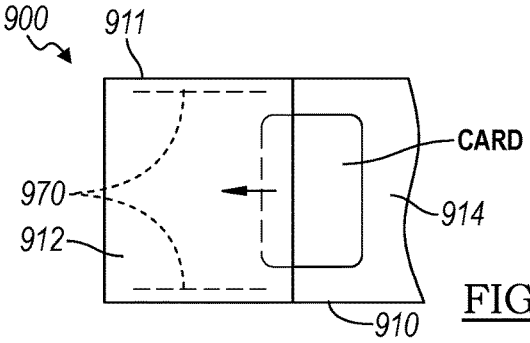

Alternatively, as shown in FIGS. 9A, 9B, and 9D, the flap section 911 can be retained over the cover section 912 with one or more fasteners 970 proximal an edge of the flap 911 and the cover section 912, such that two of four edges of the (substantially rectangular) flap section 911 (e.g., along the fold and along an edge parallel with the long edge of the rectangular sheet 910) can be constrained and coupled to the cover section 912 and two other of the four edges can be substantially unconstrained. For example, the flap section 911 can be coupled to the cover section 912 along a first edge of the flap section 911 parallel to the long edge of the rectangular sheet 910 and via the fold along the intersection of the flap section 911 and cover section 912. Thus, the short edge of the rectangular sheet 910 (i.e., an edge of the flap section 911 parallel the fold) can be substantially unconstrained) and a second edge of the flap section 911 parallel and opposite the first edge can be substantially unconstrained, such that a payment card can easily slide between the flap section 911 and the cover section 912.

Figure 5:
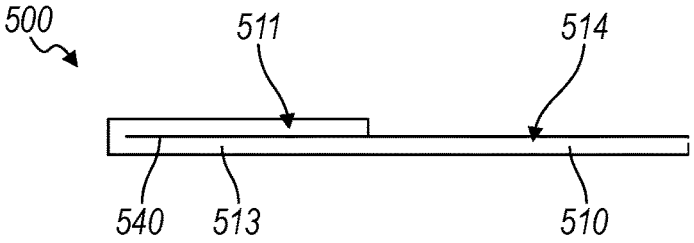
FIG. 5 is a schematic representation of a variation of the wrap wallet.

Alternatively, the flap section 511 can be folded over the back section 513, as shown in FIG. 5.

In one implementation, as shown in FIGS. 10C and 10D, the flap section 1011 can be substantially triangular, such that a long leg of the triangular flap section 1011 coincides with the intersection of the flap section 1011 and the cover section 1012 and a short leg of the triangular flap section 1011 substantially parallel the long edge of the rectangular sheet 110. Thus, when the flap section 1011 folds over the cover section 1012, the flap section 1011 defines a triangular flap, an edge of which crosses substantially diagonally across the cover section 1012. The flap section 1011 can be constrained and coupled to the cover section 1012 along the short leg of the triangular flap, the short leg of the triangular flap extending across an edge of the cover section 1012 parallel the long edge of the rectangular sheet 1010. One or more cards can be inserted between the triangular flap section 1011 and the cover section 1012.

Alternatively, the flap section 1011 and cover section 1012 can be of any other shape such that the flap section 1011 and cover section 1012 can cooperate to define a pocket that retains one or more payment cards. For example, the flap section 1011 can define a substantially rectangular shape with an ovular window cut through the center of the flap section 1011, the flap section 1011 coupled to the cover section 1012 along the fold coincident the intersection of the flap section 1011 and the cover section 1012. In another example, the flap section 1011 can define two small triangular segments.

Figure 12B:
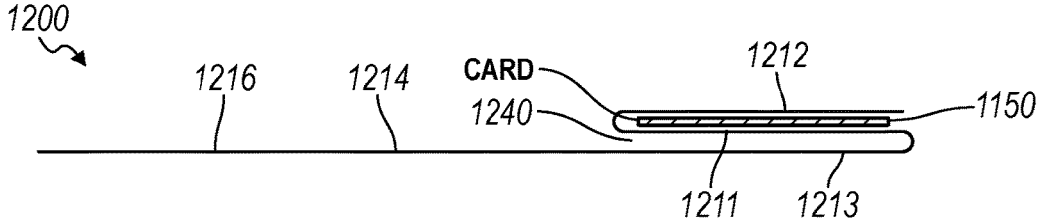
Figure 12C:
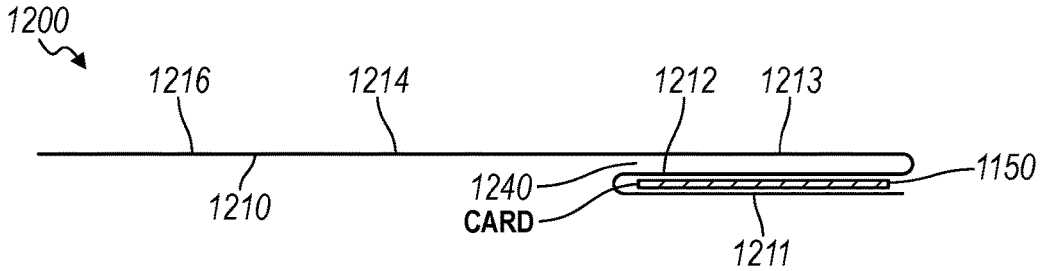
Figure 12D:
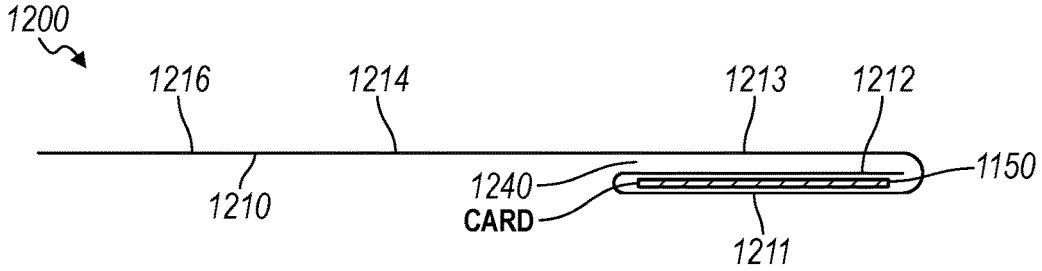

In another implementation shown in FIGS. 12B and 12D, the card pocket 1250 can be defined by folding the flap section 1211 over the cover section 1212 along the intersection between the flap section 1211 and the cover section 1212, the outer surface of the flap section 1211 adjacent the outer surface of the cover section 1212. In this implementation, one or more standard size cards may be inserted between the outer surface of the flap section 1211 and the outer surface of the cover section 1212.

Figure 6:
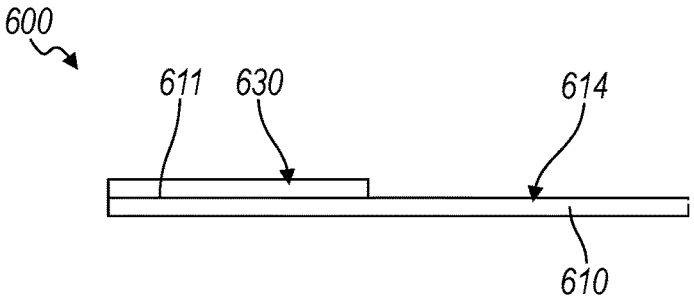
FIG. 6 is schematic representation of a variation of the wrap wallet.

In another implementation shown in FIG. 6, an auxiliary rectangular sheet 630 of the wrap wallet 600 can be of a width substantially of the card length and of a length corresponding to at least two multiples of the card width, the auxiliary rectangular sheet 630 defining an interior surface and an exterior surface, the interior surface defining a coefficient of friction greater than the coefficient of friction of the exterior surface, can be folded over the flap section 611,such that the inner surface of the flap section 611 is adjacent the interior surface of a first half of the auxiliary rectangular sheet 630 and the outer surface of the flap section 611 is adjacent the interior surface of a second half of the auxiliary rectangular sheet 630. The variant of the wrap wallet 600 in FIG. 6 also includes a middle tensile section 614 of the rectangular sheet 610. A fastener 970 (or set of fasteners 970) or other means of coupling materials can couple an edge of the auxiliary rectangular sheet to a proximal edge of the flap section 911 to retain the auxiliary rectangular sheet over the flap section 911, as shown in FIGS. 9A-9G. Thus, the auxiliary rectangular sheet can cooperate with the flap section 911 to define an interior card pocket 950 proximal the inner surface of the flap section 911 and an exterior card pocket 950 proximal the outer surface of the flap section 911 for storage of more standard size cards within the wrap wallet lee 900. For example, the auxiliary rectangular sheet can define laser cut holes along an edge of the auxiliary rectangular sheet parallel the long edge of the rectangular sheet 910, each hole in the first half of the auxiliary coincident a hole laser cut proximal the long edge of the rectangular sheet 910 corresponding to the flap section 911 and coincident a hole in the second half parallel the long edge of the rectangular sheet 910. Thus, the auxiliary rectangular sheet can be sewn along long edges of the auxiliary rectangular sheet to edges of the flap section 911 parallel the long edge of the rectangular sheet 910, thereby defining card pockets 950 in which cards can be inserted into the card pocket 950 longitudinally. For example, a user may insert a card from by pushing a card from the cover section 912 toward the flap section 911, the card sliding between the flap section 911 and the auxiliary rectangular sheet.

In a similar implementation, the auxiliary rectangular sheet can be of a width substantially of the card length and of a length corresponding to at least the card width. In this implementation, the auxiliary rectangular sheet can be coupled to edges of the flap section along two (or more) edges of the auxiliary rectangular sheet. For example, two edges of the auxiliary rectangular sheet can be coupled to edges of the flap section proximal the long edges of the rectangular sheet, thereby forming a band under which the wrap wallet can store one or more cards. In another example, two edges of the auxiliary rectangular sheet can be couple to edges of the flap section proximal the long edges of the rectangular sheet and a third edge of the auxiliary rectangular sheet can be coupled to the short edge of the flap section. Thus, the auxiliary rectangular sheet can cooperate with the flap section to form a pocket with an opening adjacent the intersection between the cover section and the flap section. A variant of the wrap wallet 1000 with an auxiliary rectangular sheet is shown in FIGS. 10A-10G (flap section 1011, rectangular sheet 1010, cover section 1012)

4. Bill Pocket

The bill pocket 240, 340, 440, 540, 840, as shown in the variants in FIGS. 2, 3, 4, 5, and 8A-8D, for retaining a short end of the bill of paper currency can be defined by folding the card pocket 250, 450, 850 over the back section 413, 513, 813 such that the card pocket 250, 450, 550, 850 is retained over the back section 413, 513, 813 with a pair of fasteners 270, 370, 870 penetrating the back section 413, 513, 813, the flap section 411, 511, 811, and the cover section 212, 312, 412, 812. A first fastener 270, 370, 870 in the pair of fasteners 270, 370, 870 can be proximal the long edge of the rectangular sheet 210, 310, 410, 510, 810; a second fastener 270, 370, 870 in the pair of fasteners 270, 370, 870 can be proximal a second long edge of the rectangular sheet 210, 310, 410, 510, 810 opposite the long edge. The bill pocket 240, 340, 440, 540, 840 is configured to receive and retain the short end of the bill, the short end corresponding to at least one-third of a length of the bill, the bill oriented parallel the long edge of the rectangular sheet 210, 310, 410, 510, 810. Furthermore, the bill pocket 240, 340, 440, 540, 840 is configured to fold over the tensile middle section 214, 314, 414, 514, 814 retaining the bill between the cover section 212, 312, 412, 812 and the middle tensile section 214, 314, 414, 514, 814, the outer surface of the cover section 212, 312, 412, 812 adjacent the inner surface of the tensile middle section 214, 314, 414, 514, 814. The end flap section 416, 816 is configured to fold over the back section 413, 513, 813, the outer surface of the back section 413, 513, 813 adjacent the inner surface of the end flap section 416, 816, the end flap section 416, 816 substantially aligned with the bill pocket 240, 340, 440, 540, 840, the end flap section 416, 816 configured to substantially enclose and retain the bill and the payment card within the width dimension of the rectangular sheet 210, 310, 410, 510, 810. Generally, the bill pocket 240, 340, 440, 540, 840 functions to retain a portion of a bill of paper currency between the card pocket 250, 450, 850 and the back section 413, 513, 813 of the rectangular sheet 210, 310, 410, 510, 810. The bill pocket 240, 340, 440, 540, 840 can store a bill of paper currency such that the bill is relatively easy to access (i.e., withdraw from the wrap wallet 200, 300, 400, 500, 800) and, in the open configuration of the wallet, is in a substantially planar, unfolded state (e.g., not crumpled). Additionally, the bill pocket 240, 340, 440, 540, 840 functions to retain a portion of a bill of paper currency (e.g., one-fourth, one-third, one-half a length of a bill of paper currency) instead of supporting the entirety of the length of the bill (e.g., in a longitudinal pocket).

As shown in FIG. 12A, the bill pocket 1240 can be defined by folding the card pocket 1250 (the inner surface of the flap section 1211 adjacent the inner surface of the cover section 1212) over the back section 1213 of the rectangular sheet 1210, such that the outer surface of the flap section 1211 is adjacent the inner surface of the back section 1213. Thus, one or more bills can be retained between the outer surface of the flap section 1211 and the inner surface of the back section 1213. The card pocket 1250 can be retained over the back section 1213 by adhering, fastening, or otherwise coupling an edge or multiple edges of the back section 1213 parallel the long edge of the rectangular sheet 1210 to an adjacent edge of the flap section 1211 parallel the long edge of the rectangular sheet 1210.

As shown in FIG. 12B, the bill pocket 1240 can be defined by folding the card pocket 1250 (the outer surface of the flap section 1211 adjacent the outer surface of the cover section 1212) over the back section 1213, such that the inner surface of the flap section 1211 is adjacent the inner surface of the back section 1213. Thus, one or more bills can be retained between the inner surface of the flap section 1211 and the inner surface of the back section 1213.

As shown in FIG. 12C, the bill pocket 1240 can be defined by folding the card pocket 1250 (the inner surface of the flap section 1211 adjacent the inner surface of the cover section 1212) over the back section 1213, such that the outer surface of the cover section 1212 is adjacent the outer surface of the back section 1213. Thus, one or more bills can be retained between the outer surface of the cover section 1212 and the outer surface of the back section 1213.

As shown in FIG. 12D, the bill pocket 1240 can be defined by folding the card pocket 1250 (the outer surface of the flap section 1211 adjacent the outer surface of the cover section 1212) over the back section 1213, such that the inner surface of the cover section 1212 is adjacent the inner surface of the back section 1213. Thus, one or more bills can be retained between the inner surface of the back section 1213 and the inner surface of the cover section 1212.

In each of the aforementioned implementations of the bill pocket, the card pocket can be retained over the back section by any fastening or coupling means, such as stitching. Fasteners can be distributed along an edge of the back section (e.g., a first edge parallel the long edge of the rectangular sheet, a second edge opposite and parallel the first edge, and/or an edge parallel and substantially coincident an intersection between the back section and the cover section). For example, stitches distributed in a zig-zag pattern parallel and proximal a long edge of the rectangular sheet can penetrate through the cover section, the flap section, and the back section, thereby retaining the flap section over the cover section (forming the card pocket) and retaining the card pocket over the back section. A variant of a wrap wallet 700 is shown in FIGS. 7A and 7B (rectangular sheet 710, external card pocket 750, first half section 731, end flap section 716, second half section 732, internal card pocket 750, bill pocket 740, window or slot 780, second rectangular sheet 730, back section 713, flap section 711, cover section 712, middle tensile section 714, fasteners 770). A variant of a wrap wallet 900 is shown in FIG. 9 (fasteners 970, back section 913, rectangular sheet 910, back section 913, cover section 912, flap section 911, card pocket 950, middle tensile section 914).

However, the bill pocket can retain the bill along the center of the bill longitudinal axis, or retain any other suitable portion of the bill. The bill pocket can be a low-friction retention mechanism, wherein folding of the card pocket over the bill functions to retain and substantially envelop the bill between the card pocket and the middle tensile section. However, the bill pocket can also be a high-friction retention mechanism, wherein the material forming the bill pocket is a high friction material, is lined with a high friction material (e.g., sandpaper, rubber, etc.) along all or a portion of the bill pocket configured to couple to the bill, or include any other suitable feature. The bill pocket is a pocket (e.g., a recess between theback section and the card pocket), but can alternatively be a clip coupled (e.g., adhered, sewn, riveted, etc.) to the short end of the bill. The pocket is substantially flat and is formed from a first and second pocket section. However, the bill pocket can be constructed in any other suitable manner. The pocket is sealed along three adjacent edges, but can alternatively be sealed along two adjacent edges. The bill pocket opening can be defined along a long edge of the rectangular sheet, but can also be defined along a short edge of the rectangular sheet. Alternatively, the bill pocket opening can be defined by a cut through the thickness of the card pocket, wherein the cut can be substantially parallel or at any suitable angle to a short edge of the rectangular sheet or a long edge of the rectangular sheet of the pocket.

5. Second Rectangular Sheet

Figure 11C:
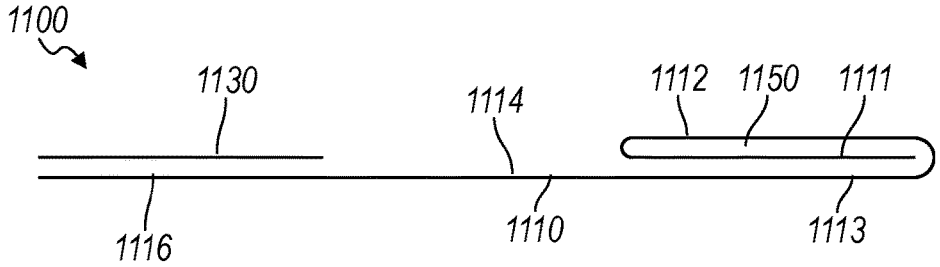
Figure 11D:
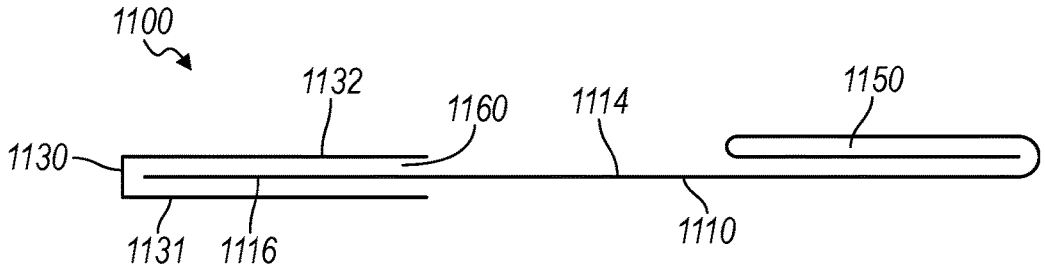

Some variations of the wrap wallet shown in FIGS. 11D, 8A, and 8B, include the second rectangular sheet 830, 1130 defining an interior surface and an exterior surface, the interior surface defining a coefficient of friction greater than a coefficient of friction of the exterior surface, the second rectangular sheet 830, 1130 defining two serial sections, each section of at least the card length and the card width, the interior surface of a first serial section of the second rectangular sheet 810, 1110 coupled to the outer surface of the end flapdefining an external card pocket 850, 1150, the interior surface of a second serial section of the second rectangular sheet 830, 1130 coupled to the inner surface of the end flap defining an internal card pocket 850, 1150, a pair of fasteners 870, 1170 coupling the first serial section, the end flap, and the second serial section, a first fastener 870, 1170 of the pair of fasteners 870, 1170 proximal the long edge of the rectangular sheet 810, 1110, a second fastener 870, 1170 of the pair of fasteners 870, 1170 proximal the second long edge, wherein the internal card pocket 850, 1150 is configured to receive and retain a second payment card between the end flap section 811, 1111 and the second serial section of the second rectangular sheet 830, 1130, the second payment card providing structure to the internal card pocket 850, 1150, wherein the external pocket is configured to receive and retain a third payment card between the end flap section 811, 1111 and the second serial section of the second rectangular sheet 830, 1130, the third payment card providing structure to the external card pocket 850, 1150, and wherein the end flap section 816, 1116 is configured to fold over the back section 813, 1113, the outer surface of the back section 813, 1113 adjacent the internal card pocket 850, 1150, the internal card pocket 850, 1150 and external card pocket 850, 1150 substantially aligned with the bill pocket 840, 1140, the end flap section 816, 1116, the internal pocket, and the external pocket configured to substantially enclose and retain the bill and the payment card within the width dimension of the rectangular sheet 810, 1110 and retain the internal pocket adjacent the back section 813, 1113. Generally, the second rectangular sheet 830, 1130 functions to define the second card pocket 860, 1160, which can retain one or more cards and functions to substantially envelop and enclose the bills within the bill pocket 840, 1140 and cards within the card pocket 850, 1150. The second card pocket 860, 1160 can be defined by the end flap folded over the inner flap, a pair of fasteners 870, 1170 coupling the inner flap section 815, 1115 and the end flap section 816, 1116, a first fastener 870, 1170 of the pair of fasteners 870, 1170 proximal the long edge of the rectangularsheet 810, 1110, a second fastener 870, 1170 of the pair of fasteners 870, 1170 proximal the second long edge, wherein the second card pocket 860, 1160 is configured to receive and retain a payment card between the end flap section 811 1111 and the inner flap section 815, 1115, the card providing structure to the second card pocket 860, 1160, wherein the second card pocket 860, 1160 is configured to fold over the back section 813, 1113, the outer surface of the back section 813, 1113 adjacent the second card pocket 860, 1160, the second card pocket 860 1160 substantially aligned with the bill pocket 840, 1140 and configured to substantially enclose and retain the bill and the payment card within the width dimension of the rectangular sheet 810, 1110 and retain second card pocket 860, 1160 adjacent the back section 813, 1113. Generally, the second card pocket 860, 1160 functions to retain a second payment card of ISO/IEC 7810 ID-1 standard size or a set of ISO/IEC 7810 ID-1 standard size cards and to substantially envelop the card pocket 850, 1150, cards within the card pocket 850, 1150, the bill pocket 840, 1140, and bills retained within the bill pocket 840, 1140.

As seen in the variations shown in FIGS. 1B, 8B and 11D, the second card pocket 160, 860, 1160 can be defined by the second rectangular sheet 130, 830, 1130 coupled to the end flap section 116, 816, 1116 of the rectangular sheet 110, 810, 1110. The second rectangular sheet 130, 830, 1130 can be of a width dimension corresponding substantially to the card length and of a length dimension corresponding to at least two multiples of the card width. The second card pocket 160, 860, 1160 can be reinforced, such as with a metal (e.g., nitinol), or plastic member, such that the second card pocket 160, 860, 1160 is substantially rigid. In these variations along with the variation seen in FIG. 4, the second rectangular sheet 130, 430, 830, 1130 can define two sections: a first half section 131, 431, 831, 1131 and a second half section 132, 432, 832, 1132. The second rectangular sheet 130, 430, 830, 1130 can also define an interior surface and an exterior surface, the interior surface defining a coefficient of friction equal to or greater than a coefficient of friction of the exterior surface. In these variations, the first half section 131, 431, 831, 1131 of the second rectangular sheet 130, 430, 830, 1130 can be coupled to the outer surface of the end flap section 116, 416, 816, 1116 and the second half section 132, 432, 832, 1132 of the second rectangular sheet 130, 430, 830, 1130 can be coupled to the inner surface of the end flap section 116, 416, 816, 1116. For example, the interior surface of the first half section 131, 431, 831, 1131 can be adhered along two of four edges of the first half section 131, 431, 831, 1131 to the outer surface of the end flap section 116, 416, 816, 1116. Alternatively, the exterior surface of the rectangular sheet 110, 410, 810, 1110 can be coupled adjacent the end flap section 116, 416, 816, 1116, such that the exterior surface of the first half section 131, 431, 831, 1131 is adjacent the outer surface of the end flap section 116, 416, 816, 1116 and the exterior surface of the second half section 132, 432, 832, 1132 is adjacent the inner surface of the end flap section 116, 416, 816, 1116. The first half section 131, 431, 831, 1131 can cooperate with end flap section 116, 416, 816, 1116 to define an external card pocket 150, 450, 850, 1150 into which a user can insert one or more standard size cards. In the wrapped configuration, the external card pocket is accessible to a user, such that a user can insert and/or retrieve a card from the external card pocket. The external card pocket can include a window cut through the first half section, such that the user can see a card face (e.g., a face of a Government Identification card) through the external card pocket while retaining edges of the card. For example, the window can define a half-ovular cutout window in the broad face of the second pocket proximal the second opening to aid removal of a card from the (external) card pocket. The second half section can cooperate with the end flap section to define an internal card pocket to retain one or more standard size cards. The internal card pocket can function to retain a second short end of the bill opposite the short end of the bill retained within the bill pocket. For example, the wrap wallet holds a bill of a large currency amount (e.g., one hundred dollars) that a user may not use at a regular frequency, the user may tuck the second short end of the bill of the large currency into the internal card pocket. The internal card pocket can also retain one or more cards of standard size. The second half section can also include a window or slot through the second rectangular sheet, such that a portion of a face of a card within the internal card pocket can be seen through the internal card pocket while retaining the edges of the card within the pocket. A variant of a wrap wallet 700 in the wrapped and unwrapped configurations are shown in FIGS. 7A and 7B, respectively (external card pocket 750, first half section 731, end flap section 716, second half section 732, internal card pocket 750, bill pocket 740, window or slot 780, second rectangular sheet 730).

Figure 8D:
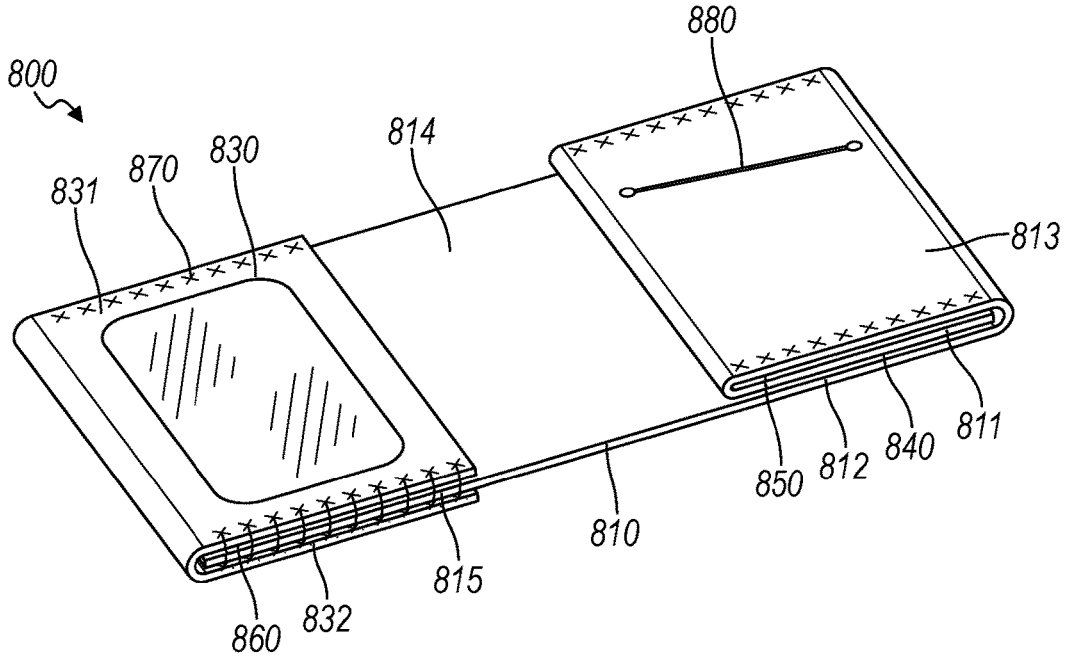

The second rectangular sheet can be retained over the end flap section by any fastening means, such as stitches, rivets, nails, staples, etc., distributed proximal one or more edges of the end flap section (e.g., an edge proximal an intersection between the first half section and the second half section, either edge parallel the long edge of the rectangular sheet, an edge proximal an intersection between the middle tensile section and the end flap section). For example, the first half section of the second rectangular sheet can be sewn through the end flap section to the second half section, wherein stitches penetrate through the first half section, the end flap section, and the second half section. The stitches can for a substantially linear pattern along a first edge of the end flap section parallel and proximal the long edge of the rectangular sheet and along a second edge of the end flap section 816 parallel and proximal a second long edge of the rectangular sheet, the first half section and second half section lying substantially flat (i.e., coincident) over the end flap section. The first half section and/or the second half section can span an entirety the length of the end flap section, thereby covering the end flap section. Alternatively, the first half section and/or the second half section can span a portion (e.g., a corner or span half the length of the end flap section). A variant of a wrap wallet with the second rectangular sheet is shown in FIGS. 8A and 8D (second rectangular sheet 830, end flap section 816, first half section 831, second half section 832, rectangular sheet 810, middle tensile section 814, flap section 811).

In a similar variation shown in FIG. 11C, the second rectangular sheet 1130 can be of a width dimension corresponding substantially to the card length and of a length dimension corresponding to at least the card width. The second rectangular sheet 1130 can be arranged substantially over the outer surface of the end flap section 1116 or over the inner surface of the end flap section 1116. The second rectangular sheet 1130 can be retained over the end flap section 1116 along the periphery of the second rectangular sheet 1130 or a portion of the periphery of the second rectangular sheet 1130, the periphery of the second rectangular sheet 1130 substantially coincident a periphery of the end flap section 1116.

In one variation shown in FIGS 11A and 11B, the second card pocket 1160 can be defined by folding the end flap section 1116 of the rectangular sheet 1110 with six sections over the inner flap section 1115. In one implementation of the variation, the inner surface of the end flap section 1116 can be adjacent the inner surface of the inner flap section 1115, thereby defining the second card pocket 1160 between the end flap section 1116 and the inner flap section 1115. Thus, the second card pocket 1160 can be arranged on the same side of the rectangular sheet 1110 (i.e., the inner surface) as the (first) card pocket 1150.

In another implementation of the variation shown in FIG. 11B, the end flap section 1116 can be folded over the inner flap section 1115 such that the outer surface of the end flap section 1116 is adjacent the outer surface of the inner flap section 1115.

In another implementation of the variation, the second card pocket can define an opening to accept the payment card between the end flap section and the inner flap section, the opening parallel a short edge of the rectangular sheet and proximal an intersection between the inner flap section and the middle tensile section.

6. Examples

In one example application, an elastic cord (e.g., elastolefin) or other elastic fastener can retain the flap section over the cover section to define the card pocket, the card pocket over the back section to define the bill pocket, and the end flap section over inner flap section to define the second card pocket. The elastic cord can function to define expandable pockets, which can accommodate various numbers of standard size cards and bills of paper currency within the wrap wallet. The elastic cord can accommodate few cards and/or bills, the elastic cord shrinking to tightly retain and envelop the cards and/or bills closely. Alternatively, the elastic cord can stretch to envelop many cards (e.g., ten credit cards) and/or many bills (e.g., twenty one dollar bills).

In another example application, the wrapping wallet can additionally include a retention mechanism, which functions to transiently retain the wrapping wallet in the wrapped configuration. The retention mechanism functions to transiently retain the position of the first and/or second wallet section position relative to the short end of the bill when in the wrapped configuration. The retention mechanism is a paired coupling mechanism, and includes a first and a second coupling mechanism. The first coupling mechanism exerts or generates an attractive force toward the second coupling mechanism, but can alternatively mechanically retain the second coupling mechanism. Examples of the retention mechanism include a magnet and a ferrous element (e.g., a magnet or a material including iron), a button and a buttonhole (e.g., defined by a cut in the wrapping wallet material or a loop connected to the wrapping wallet material), clips, Velcro, a tongue and groove system, or any other suitable retention mechanism. The wrapping wallet includes one retention mechanism, but can alternatively include two, three, or any other suitable number of retention mechanisms. The retention mechanism(s) is evenly distributed along the length of a free wallet edge (e.g., the long edge of the rectangular sheet of the wrapping wallet in the wrapped configuration, short edge of the rectangular sheet of the wrapping wallet in the open configuration) in the wrapped configuration, but can alternatively be unevenly distributed. Alternatively, the retention mechanism can be arranged anywhere along the broad face of a wallet section. For example, in one variation of the wrapping wallet including a short end of the bill, a first wallet section, and a second wallet section, the retention mechanism can include a magnet and a ferrous element, wherein the magnet is arranged within the bill pocket 740 lumen proximal the bill pocket 740 opening, and the ferrous element is arranged along the free edge of the second wallet section parallel the bill pocket 740 opening (e.g., as shown in FIG. 7). When the ferrous element is a second magnet, the first and second magnets are arranged such that the resultant attractive force biases the face of the second wallet section that is continuous with the interior surface of the first pocket section toward the outer surface of the first pocket section.

In another variation, the rectangular sheet can define a length dimension corresponding to two multiples of the card width, the rectangular sheet including a first section and a second section. In this variation, one or more cards can be retained adjacent and parallel the first section and one or more cards can be retained adjacent and parallel the second section with a clip, a clasp, or other feature coupling an edge of a card to an edge of the rectangular sheet. The first section can be folded over the second section, thereby defining a bi-fold wallet.

In another variation, the rectangular sheet can define a length dimension corresponding to three multiples of the card width, the rectangular sheet including the flap section, the middle tensile section, and an end flap section. The flap section can be configured to retain one or more cards adjacent and parallel the flap section with clips, clasps, or other feature coupling an edge of a card to an edge of the rectangular sheet coincident the flap section. The flap section can be folded over the middle tensile section. The end flap section can be folded over the flap section, the end flap section configured to retain one or more cards with a clasp, clip, or other feature coupling an edge of a card to an edge of the rectangular sheet and the end flap section.

In another variation, the rectangular sheet can define a length dimension corresponding to four multiples of the card width, the rectangular sheet including the flap section, the back section, the middle tensile section, and an end flap section. The flap section can fold over the back section, defining a card pocket configured to retain a card between the flap section and the back section. The end flap section can be folded over the middle tensile section, defining a second pocket configured to retain a second card (or bills of paper currency) between the middle tensile section and the end flap section. The second pocket can fold over the card pocket, substantially enclosing the cards and/or bills and defining a bi-fold wrap wallet.

In another variation, the rectangular sheet no can define a length dimension corresponding to seven multiples (or more) of the card width, the rectangular sheet including seven sections serially arranged in the following order: the flap section, the back section, the cover section, the middle tensile section, a cover flap section adjacent, the inner flap section, and the end flap section. The flap section can fold over the back section, defining a card pocket configured to retain a card between the flap section and the back section. The end flap section can be folded over the middle tensile section, defining a second pocket configured to retain a second card (or bills of paper currency) between the middle tensile section and the end flap section. The second pocket can fold over the card pocket, substantially enclosing the cards and/or bills and defining a bi-fold wrap wallet.

As a person skilled in the art will recognize from the previous detailed description and from the figures and claims, modifications and changes can be made to the preferred embodiments of the invention without departing from the scope of this invention defined in the following claims.

I claim:

1. A wrap wallet for carrying a bill of paper currency and a payment card corresponding to an ISO/IEC 7810 ID-1 standard size, the wrap wallet comprising:

a rectangular sheet comprising an inner surface and an outer surface opposite the inner surface, the rectangular sheet of a width dimension corresponding to at least a card width of the payment card and a length dimension corresponding to greater than five multiples of a card length of the payment card, the card width greater than the card length, the rectangular sheet defining exactly five sections of the rectangular sheet, the five sections defined by a set of four folds, each of the set of four folds arranged between each adjacent pair of sections, the five sections ordered serially across the rectangular sheet from a first short edge of the rectangular sheet to an opposing short edge of the rectangular sheet opposite the first short edge, the five sections comprising a flap section, a cover section, a back section, a tensile middle section, and an end flap section arranged in order, the flap section adjacent a short edge of the rectangular sheet;

a card pocket defined by the flap section folded over the cover section, the inner surface of the flap section adjacent the inner surface of the cover section, a linear slot cut through the cover section for inserting a portion of the payment card between the inner surface of the cover section and the inner section of the flap section; wherein the card pocket is configured to receive a portion of the payment card between the cover section and the flap section and a portion of the payment card arranged over the cover section, the payment card providing a substantially rigid structure to the card pocket;

a bill pocket for retaining a short end of the bill of paper currency, the bill pocket defined by the card pocket folded over the back section, the card pocket retained over the back section with a pair of fasteners penetrating the back section, the flap section, and the cover section, the pair of fasteners comprising string sewn through the cover section, the flap section, and the back section, the string retaining the flap section between the cover section and the back section, a first fastener in the pair of fasteners proximal the long edge of the rectangular sheet, a second fastener in the pair of fasteners proximal a second long edge of the rectangular sheet opposite the long edge; wherein the bill pocket is configured to receive and retain the short end of the bill, the short end corresponding to at least one-third of a length of the bill, the bill oriented parallel the long edge of the rectangular sheet; wherein the bill pocket is configured to fold over the tensile middle section retaining the bill between the cover section and the middle tensile section, the outer surface of the cover section adjacent the inner surface of the tensile middle section; and wherein the end flap section is configured to fold over the back section, the outer surface of the back section adjacent the inner surface of the end flap section, the end flap section substantially aligned with the bill pocket, the end flap section configured to substantially enclose and retain the bill and the payment card within the width dimension of the rectangular sheet.

2. The wrap wallet of claim 1, wherein the inner surface defines a coefficient of friction greater than a coefficient of friction of the outer surface.

3. The wrap wallet of claim 1, wherein the linear slot defines an acute angle relative a long edge of the rectangular sheet.

4. The wrap wallet of claim 1, wherein the width dimension of the rectangular sheet corresponds to at least 85.60 millimeters and the length dimension of the rectangular sheet corresponds to at least 269.9 millimeters, each section of the five sections of a width corresponding to the width dimension and a length corresponding to at least 53.98 millimeters.

5. The wrap wallet of Claim 1, wherein the card pocket is configured to retain a plurality of cards corresponding to the ISO/IEC 7810 ID-1 standard size; and wherein the bill pocket is configured to retain a plurality of bills of paper currency.

6. The wrap wallet of claim 1, wherein the rectangular sheet comprises a rectangular sheet of leather, the inner surface of the rectangular sheet corresponding to a flesh side of the rectangular sheet of leather and the outer surface of the rectangular sheet corresponding to a grain side of the rectangular sheet of leather.

7. The wrap wallet of claim 1, further comprising a relief hole coincident an end of the linear slot, the relief hole limiting propagation of the linear slot beyond the cover section.

8. The wrap wallet of claim 1, further comprising an auxiliary rectangular sheet coupled to the outside of the back section along a three edges of a periphery of the back section parallel the long edge of the rectangular sheet and a short edge.

9. The wrap wallet of claim 1, wherein the rectangular sheet comprises a first layer and a second layer, the first layer sewn to the second layer, the first layer defining the inner surface, the second layer defining the outer surface.

10. The wrap wallet of claim 1, further comprising a second rectangular sheet defining an interior surface and an exterior surface, the interior surface defining a coefficient of friction greater than a coefficient of friction of the exterior surface, the second rectangular sheet defining two serial sections, each section of at least the card length and the card width, the interior surface of a first serial section of the second rectangular sheet coupled to the outer surface of the end flap defining an external card pocket, the interior surface of a second serial section of the second rectangular sheet coupled to the inner surface of the end flap defining an internal card pocket, a pair of fasteners coupling the first serial section, the end flap, and the second serial section, a first fastener of the pair of fasteners proximal the long edge of the rectangular sheet, a second fastener of the pair of fasteners proximal the second long edge; wherein the internal card pocket is configured to receive and retain a second payment card between the end flap section and the second serial section of the second rectangular sheet, the second payment card providing structure to the internal card pocket; wherein the external pocket is configured to receive and retain a third payment card between the end flap section and the second serial section of the second rectangular sheet, the third payment card providing structure to the external card pocket; and wherein the end flap section is configured to fold over the back section, the outer surface of the back section adjacent the internal card pocket, the internal card pocket and external card pocket substantially aligned with the bill pocket, the end flap section, the internal pocket, and the external pocket configured to substantially enclose and retain the bill and the payment card within the width dimension of the rectangular sheet and retain the internal pocket adjacent the back section.

11. A wrap wallet of Claim 10, wherein the rectangular sheet comprises a flexible, material and the second rectangular sheet comprises a substantially rigid plastic.

12. The wrap wallet of claim 1, wherein the flap section is continuous with the cover section.

* * * * *